US008249219B2

(12) United States Patent
Parker

(10) Patent No.: US 8,249,219 B2
(45) Date of Patent: Aug. 21, 2012

(54) X-RAY TUBE ROTATING ANODE

(75) Inventor: Todd S. Parker, Kaysville, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 251 days.

(21) Appl. No.: 12/817,373

(22) Filed: Jun. 17, 2010

(65) Prior Publication Data

US 2011/0311028 A1 Dec. 22, 2011

(51) Int. Cl.
*H01J 35/10* (2006.01)

(52) U.S. Cl. ..... 378/141; 378/127

(58) Field of Classification Search ..... 378/125, 378/127, 141, 143, 144, 119
See application file for complete search history.

(56) References Cited

U.S. PATENT DOCUMENTS

| | | | | |
|---|---|---|---|---|
| H312 | H * | 7/1987 | Parker | 378/127 |
| 4,943,989 | A | 7/1990 | Lounsberry et al. | |
| 5,020,087 | A * | 5/1991 | Rix et al. | 378/134 |
| 2004/0213379 | A1 | 10/2004 | Bittl | |
| 2007/0297570 | A1 | 12/2007 | Kerpershoek et al. | |
| 2009/0268874 | A1 | 10/2009 | Albanetti et al. | |

OTHER PUBLICATIONS

International search report for related PCT Application No. PCT/US2011/040768 mailed Feb. 9, 2012.

* cited by examiner

*Primary Examiner* — Hoon Song
(74) *Attorney, Agent, or Firm* — Maschoff Gilmore & Israelsen

(57) ABSTRACT

An x-ray tube rotating anode. In one example embodiment, an x-ray tube rotating anode includes a hub configured to attach to a bearing assembly, rings positioned radially outward from the hub, bridges connecting the rings together, annular ring fins each attached to one of the rings, a focal track positioned radially outward from the annular ring fins, and annular focal track fins attached to the focal track.

20 Claims, 10 Drawing Sheets

X-RAY TUBE ROTATING ANODE

BACKGROUND

An x-ray tube directs x-rays at an intended subject in order to produce an x-ray image. To produce x-rays, the x-ray tube receives large amounts of electrical energy. However, only a small fraction of the electrical energy transferred to the x-ray tube is converted within an evacuated enclosure of the x-ray tube into x-rays, while the majority of the electrical energy is converted to heat. If excessive heat is produced in the x-ray tube, the temperature may rise above critical values, and various portions of the x-ray tube may be subject to thermally-induced deforming stresses and reductions in surface bearing properties.

For example, the bearing assembly of a rotating anode x-ray tube is particularly susceptible to excessive temperature and thermally-induced deforming stresses. In particular, as electrons are directed toward the focal track of the anode, the focal track of the anode becomes heated. This heat tends to conduct from the focal track to the bearing assembly, including the bearings. As the anode can generally sustain much higher temperatures than the bearings, the conduction of this heat can, over time, deteriorate the bearings resulting in the failure of the rotating anode.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments relate to an x-ray tube rotating anode. The example rotating anode disclosed herein efficiently radiates heat and reduces the conduction of heat, resulting in acceptably low temperatures in the bearing assembly to which the example rotating anode is attached. The efficient radiation of heat by the example rotating anode disclosed herein therefore extends the operational life of the attached bearing assembly and the associated x-ray tube.

In one example embodiment, an x-ray tube rotating anode includes a hub configured to attach to a bearing assembly, rings positioned radially outward from the hub, bridges connecting the rings together, annular ring fins each attached to one of the rings, a focal track positioned radially outward from the annular ring fins, and annular focal track fins attached to the focal track.

In another example embodiment, an x-ray tube assembly includes a can and a rotating anode positioned within the can. The can defines inner annular fins and outer annular fins. The rotating anode includes a focal track, annular focal track fins attached to the focal track and interleaved with the outer annular fins of the can, rings positioned radially inward from the focal track, annular ring fins each attached to one of the rings and interleaved with the inner annular fins of the can, bridges connecting the rings together, and a hub positioned radially inward from the rings and configured to attach to a bearing assembly.

In yet another example embodiment, an x-ray tube includes a bearing assembly, an evacuated enclosure at least partially defined by a can, a cathode positioned within the evacuated enclosure, and a rotating anode positioned within the evacuated enclosure. The can defines inner concentric fins and outer concentric fins. The rotating anode includes a focal track, concentric focal track fins attached to the focal track and interleaved with the outer concentric fins of the can, rings positioned radially inward from the focal track, concentric ring fins each attached to one of the concentric rings and interleaved with the inner concentric fins of the can, bridges connecting the rings together, and a hub positioned radially inward from the rings and attached to the bearing assembly.

These and other aspects of example embodiments of the invention will become more fully apparent from the following description and appended claims.

BRIEF DESCRIPTION OF THE DRAWINGS

To further clarify certain aspects of the present invention, a more particular description of the invention will be rendered by reference to example embodiments thereof which are disclosed in the appended drawings. It is appreciated that these drawings depict only example embodiments of the invention and are therefore not to be considered limiting of its scope. Aspects of example embodiments of the invention will be described and explained with additional specificity and detail through the use of the accompanying drawings in which.

DETAILED DESCRIPTION OF SOME EXAMPLE EMBODIMENTS

Example embodiments of the present invention relate to an x-ray tube rotating anode. The example rotating anode disclosed herein efficiently radiates heat and reduces the conduction of heat, resulting in acceptably low temperatures in the bearing assembly to which the example rotating anode is attached. The efficient radiation of heat by the example rotating anode disclosed herein therefore extends the operational life of the attached bearing assembly and the associated x-ray tube.

Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

I. Example X-Ray Tube

Figure 1A:
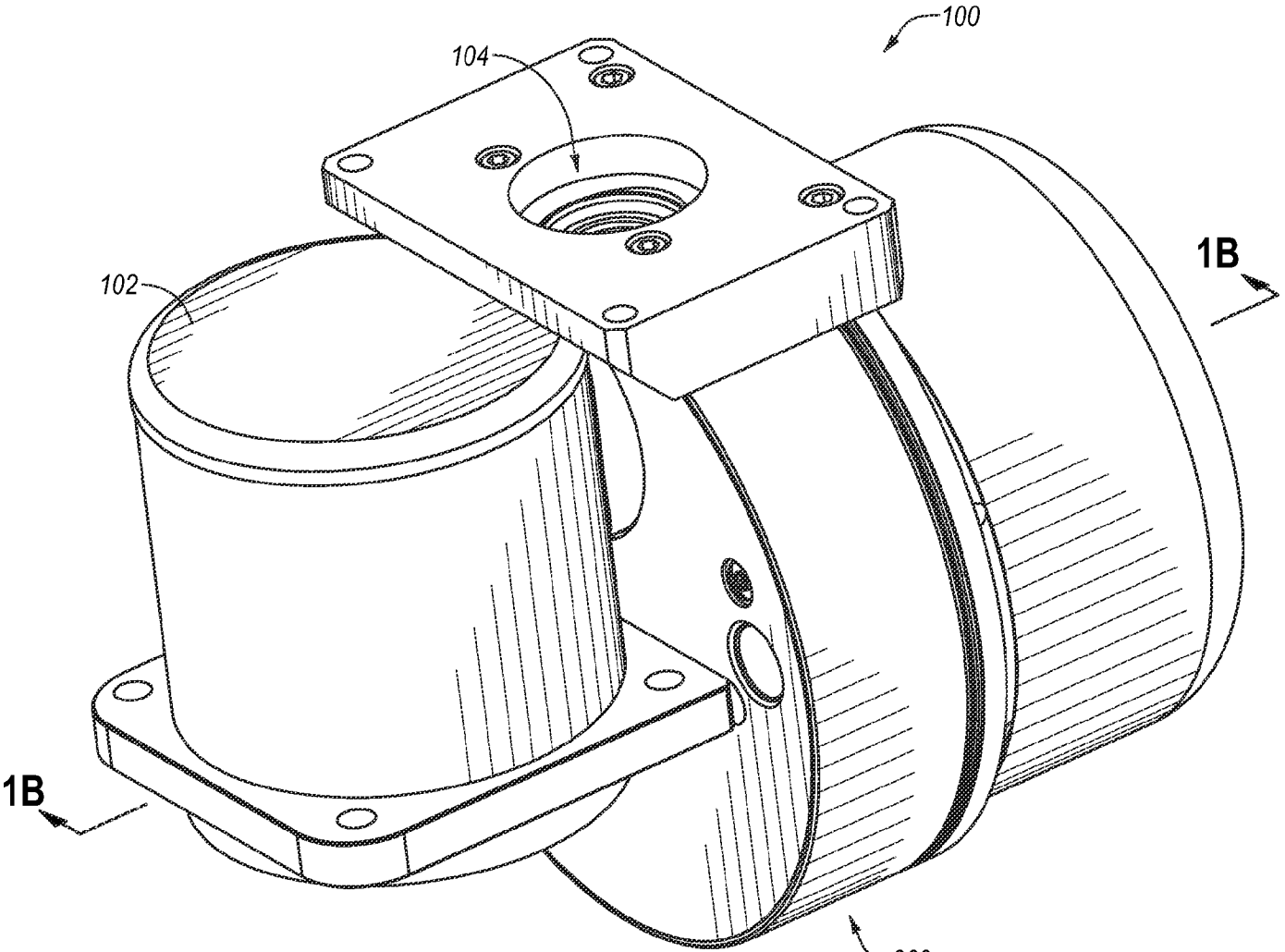
FIG. 1A is a perspective view of an example x-ray tube.
Figure 1B:
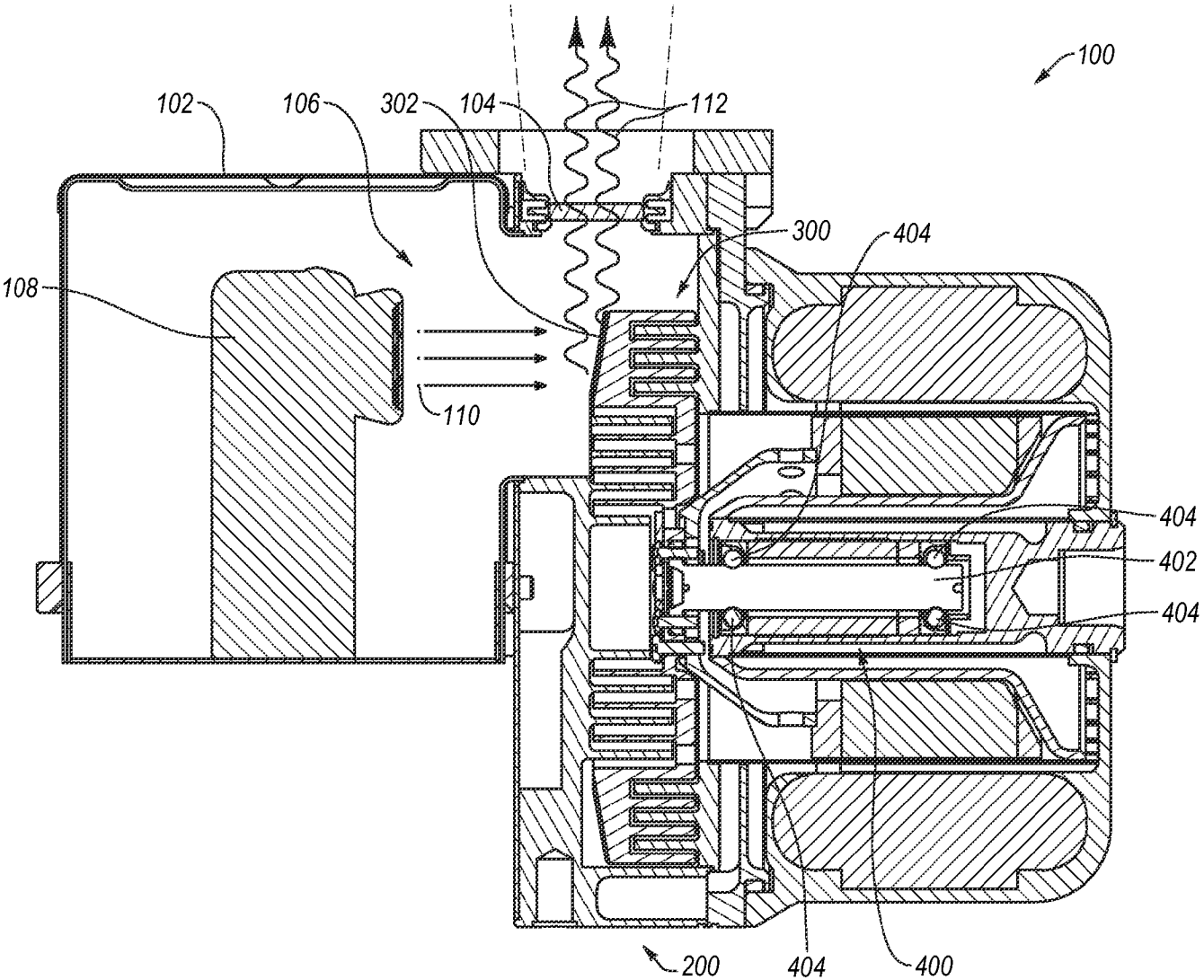
FIG. 1B is a cross-sectional side view of the example x-ray tube of FIG. 1A.

With reference first to FIGS. 1A and 1B, an example x-ray tube 100 is disclosed. As disclosed in FIG. 1A, the example x-ray tube 100 generally includes a cathode housing 102, a can 200, and an x-ray tube window 104. The x-ray tube window 104 is comprised of an x-ray transmissive material, such as beryllium or other suitable material(s). The cathode housing 102 and the can 200 may be formed, for example, from stainless steel, such as 304 stainless steel.

As disclosed in FIG. 1B, the cathode housing 102, the can 200, and the x-ray tube window 104 at least partially define an evacuated enclosure 106 within which a cathode 108 and an anode 300 are positioned. More particularly, the cathode 108 is at least partially positioned within the cathode housing 102 and the anode 300 is at least partially positioned within the can 200. The anode 300 is spaced apart from and oppositely disposed to the cathode 108. The anode 300 and cathode 108 are connected in an electrical circuit that allows for the application of a high voltage potential between the anode 300 and the cathode 108. The cathode 108 includes an electron emitter (not shown) that is connected to an appropriate power source (not shown).

As disclosed in FIG. 1B, the example x-ray tube 100 also includes a bearing assembly 400. The bearing assembly 400 includes, among other things, a spindle 402 attached to the anode 300, as well as various bearings 404 which support the spindle 402 during rotation of the spindle 402 (by a rotor for example), thus enabling the rotation of the anode 300.

As disclosed in FIG. 1B, prior to operation of the example x-ray tube 100, the evacuated enclosure 106 is evacuated to create a vacuum. Then, during operation of the example x-ray tube 100, an electrical current is passed through the electron emitter (not shown) of the cathode 108 to cause electrons 110, to be emitted from the cathode 108 by thermionic emission. The application of a high voltage differential between the anode 300 and the cathode 108 then causes the electrons 110 to accelerate from the cathode electron emitter toward a focal track 302 that is positioned on the anode 300. The focal track 302 may be composed for example of tungsten and rhenium or other material(s) having a high atomic ("high Z") number. As the electrons 110 accelerate, they gain a substantial amount of kinetic energy, and upon striking the rotating focal track 302, some of this kinetic energy is converted into x-rays 112.

The focal track 302 is oriented so that emitted x-rays 112 are visible to the x-ray tube window 104. As the x-ray tube window 104 is comprised of an x-ray transmissive material, the x-rays 112 emitted from the focal track 302 pass through the x-ray tube window 104 in order to strike an intended subject (not shown) to produce an x-ray image (not shown). The window 104 therefore seals the vacuum of the evacuated enclosure 106 of the x-ray tube 100 from the atmospheric air pressure outside the x-ray tube 100, and yet enables x-rays 112 generated by the anode 300 to exit the x-ray tube 100.

As the electrons 110 strike the focal track 302, a significant amount of the kinetic energy of the electrons 110 is transferred to the focal track 302 as heat. While the anode 300 can withstand relatively high temperatures, the bearing assembly 400 can only withstand relatively low temperatures. Accordingly, the anode 300 is specifically designed to efficiently radiate the heat generated at the focal track 302 so that only an acceptably low amount of heat conducts through the anode 300 to the bearing assembly 400, as discussed in greater detail below.

II. Example X-Ray Tube Assembly

With reference to FIGS. 2A-2D, aspects of an example x-ray tube assembly 500 are disclosed. As disclosed in FIG. 2A, the example x-ray tube assembly 500 generally includes the can 200, the anode 300, and the bearing assembly 400.

Figure 2A:
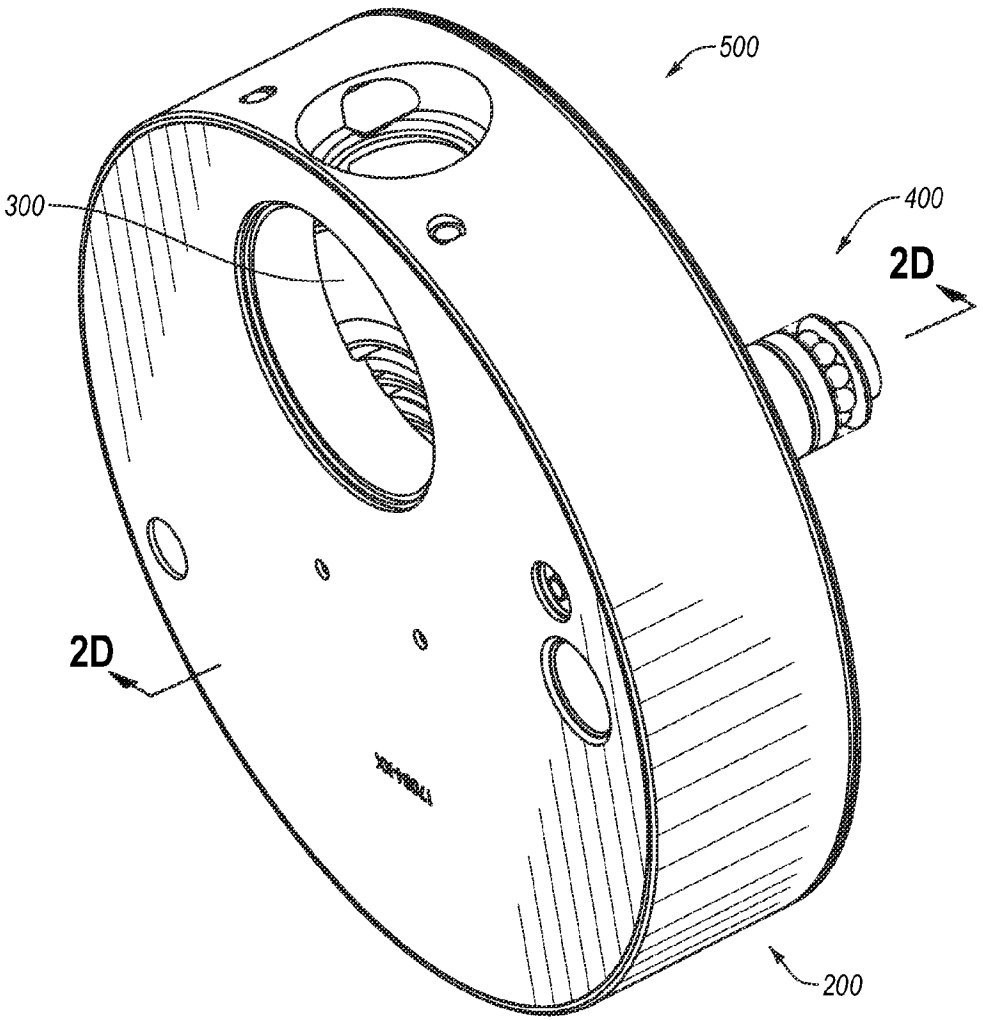
FIG. 2A is a perspective view of an example x-ray tube assembly of the example x-ray tube of FIG. 1A.
Figure 2B:
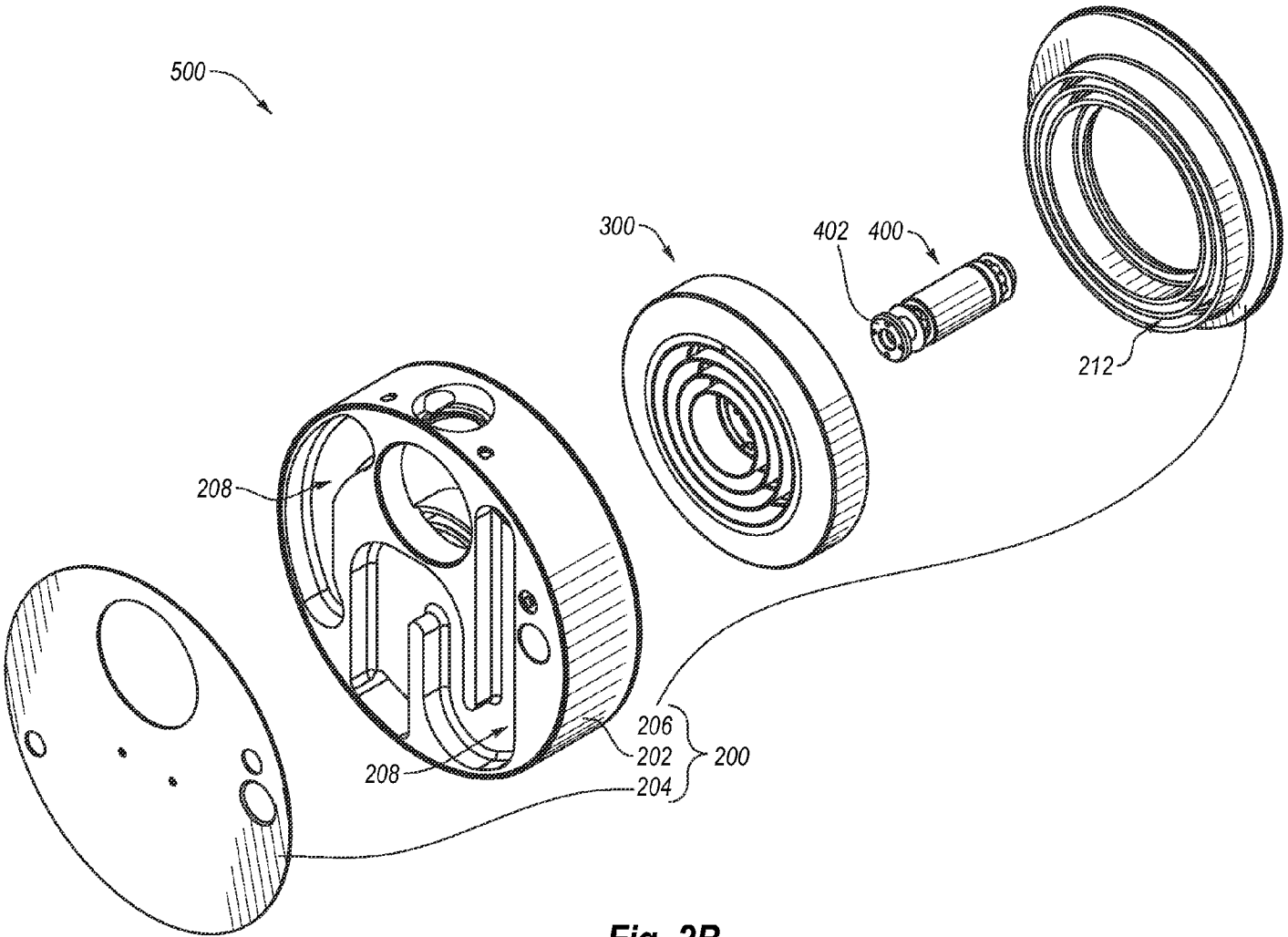
FIG. 2B is an exploded front perspective view of the example x-ray tube assembly of FIG. 2A.
Figure 2C:
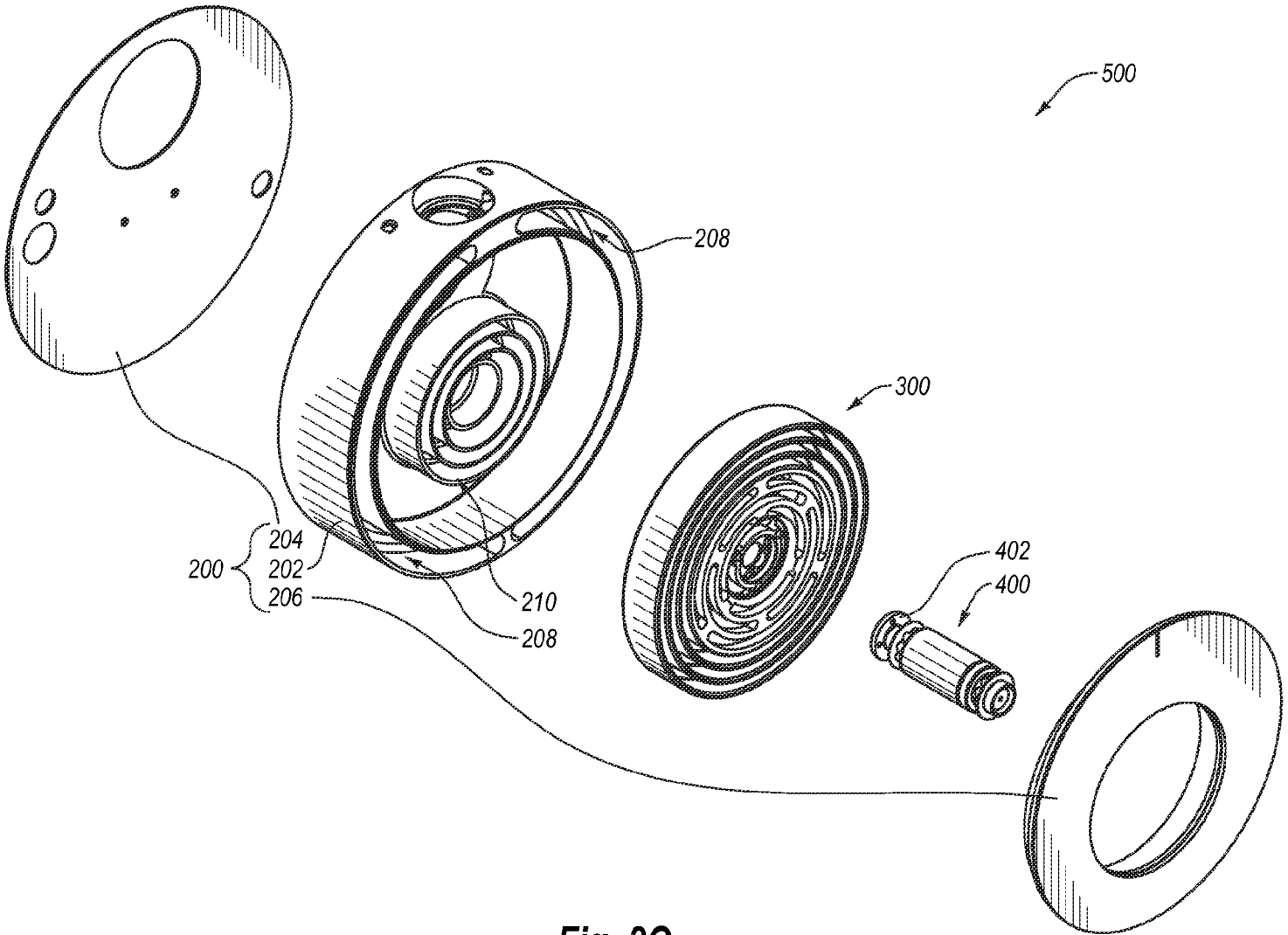
FIG. 2C is an exploded rear perspective view of the example x-ray tube assembly of FIG. 2A.

As disclosed in FIGS. 2B and 2C, the can 200 generally includes a body 202, a front cover 204, and a rear cover 206. The front cover 204 cooperates with the body 202 to enclose some of the passageways 208. The passageways 208 are configured to circulate a fluid coolant (not shown) to cool the can 200. The body 202 defines inner annular fins 210 and the rear cover 206 defines outer annular fins 212. Once the x-ray tube assembly 500 is assembled, as disclosed in FIG. 2D, the inner and outer annular fins 210 and 212 are configured to be interleaved with corresponding annular fins 304 and 306, respectively, of the anode 300.

Figure 2D:
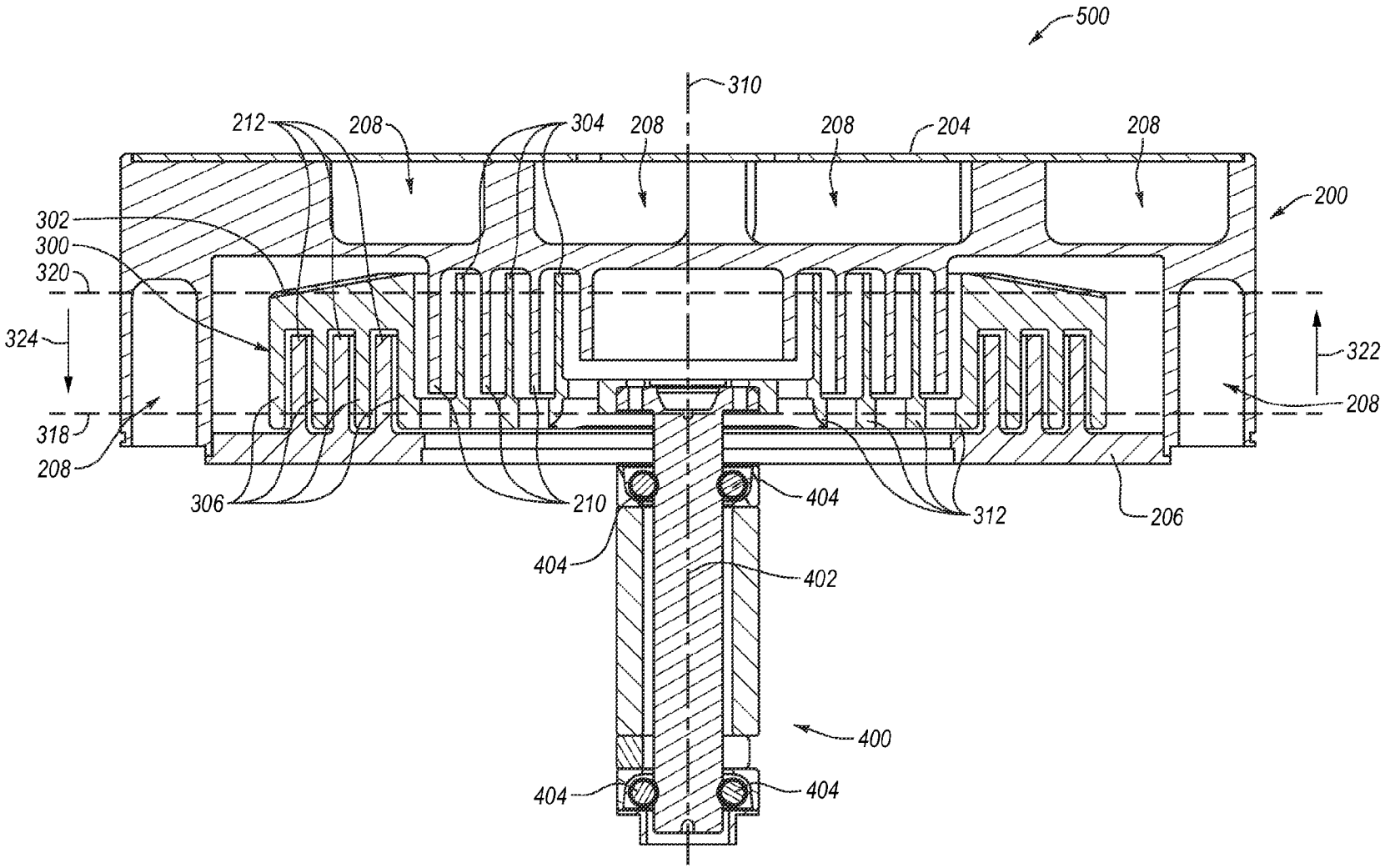
FIG. 2D is a cross-sectional view of the example x-ray tube assembly of FIG. 2A.
Figure 3A:
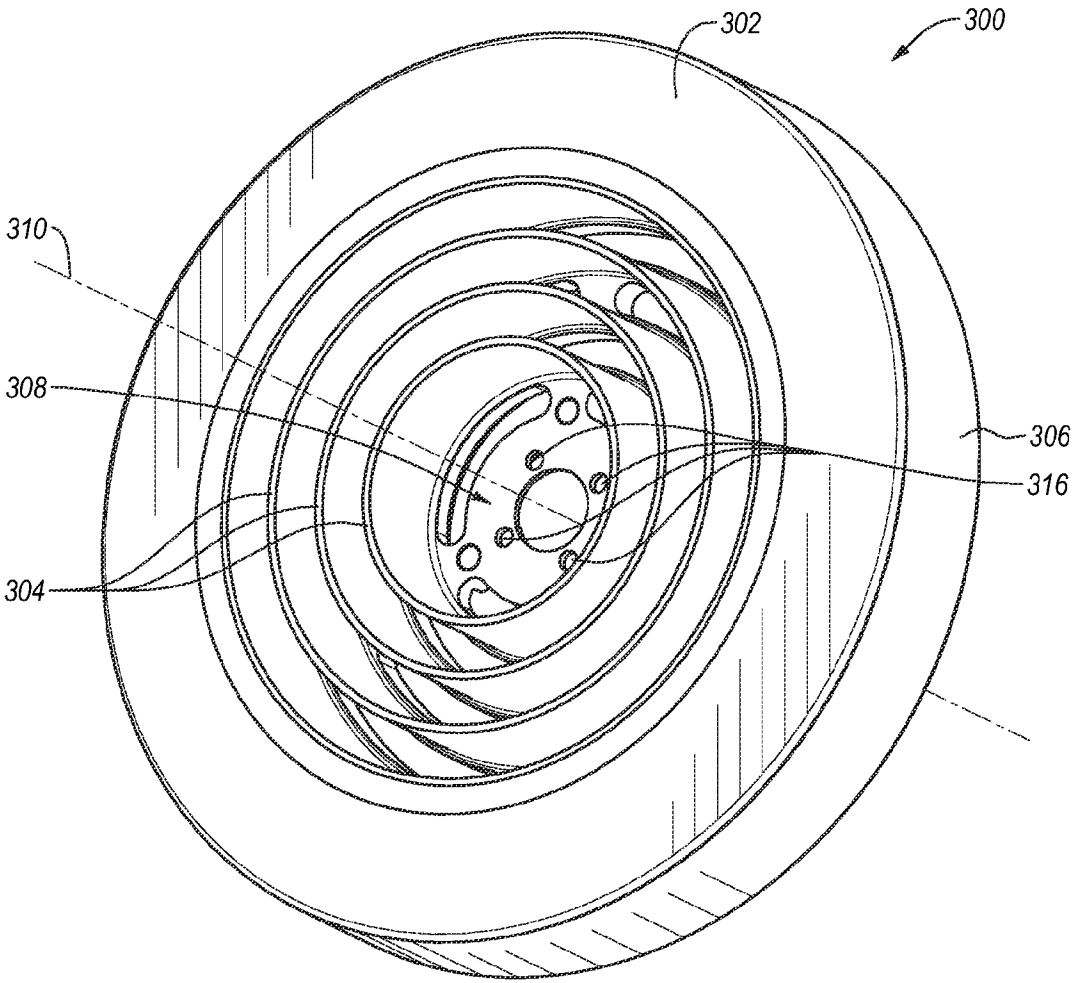
FIG. 3A is a front perspective view of an example rotating anode of the example x-ray tube assembly of FIG. 2A.
Figure 3B:
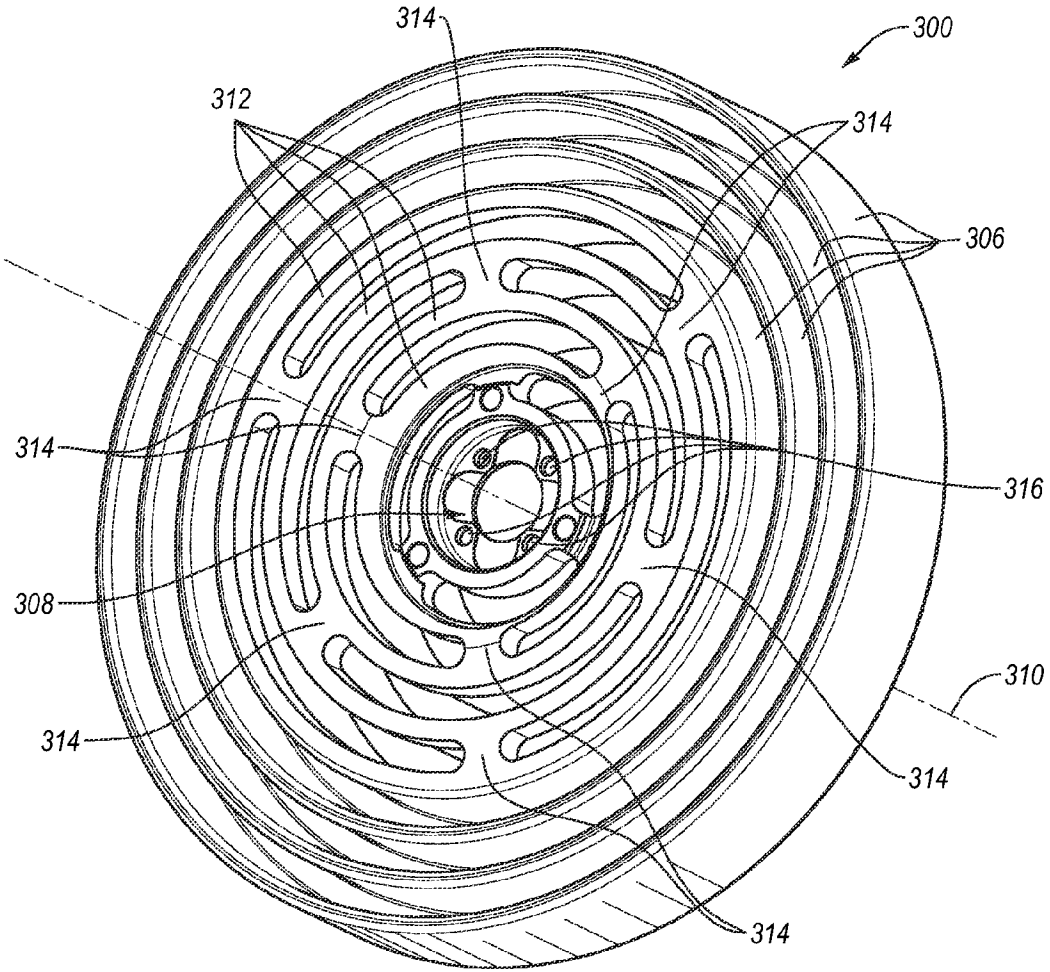
FIG. 3B is a rear perspective view of the example rotating anode of FIG. 3A.
Figure 3C:
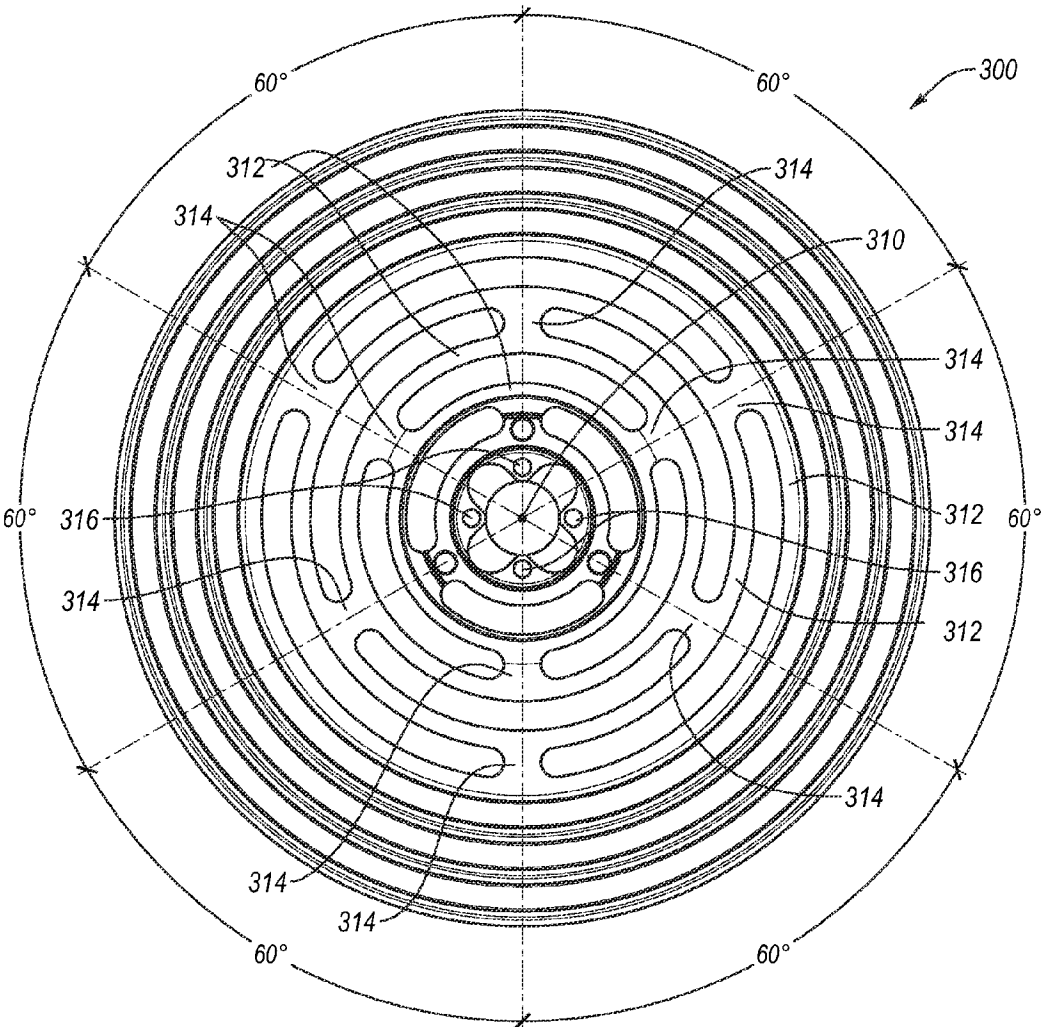
FIG. 3C is a rear view of the example rotating anode of FIG. 3A.

With continued reference to FIG. 2D, and with reference also to FIGS. 3A-3C, additional aspects of the example anode 300 are disclosed. As disclosed in FIGS. 3A and 3B, the example anode 300 includes a hub 308 defining an axis 310, four rings 312 positioned radially outward from the hub 308, bridges 314 connecting the rings 312 together, three annular ring fins 304 each attached to one of the rings 312, the focal track 302 positioned radially outward from the annular ring fins 304, and four annular focal track fins 306 attached to the underside of the focal track 302. The hub 308 is configured to attach to the rotating spindle 402 (see FIGS. 2B-2D) of the bearing assembly via four pin openings 316. Once attached, the rotation of the spindle 402 (by a rotor for example) results in the rotation of the anode 300.

The example anode 300 may be formed from a variety of materials. For example, the focal track 302 of the anode 300 may be formed from tungsten and rhenium while the fins 306, the rings 312, the fins 304, the bridges 314, and the hub 308 are formed from molybdenum, titanium, or zirconium, or some combination thereof. The example anode 300 may be formed from a sintering and machining process, for example.

As disclosed in FIG. 3C, three of the bridges 314 connect each outer ring 312 to the next successive inner ring 312. It is understood however, that in at least some example embodiments, only two bridges or four or more bridges may connect one or more outer rings to the next successive inner ring. For example, some rings may be connected with two bridges, while others are connected with three bridges, while still others are connected with four bridges.

As disclosed in FIG. 3C, the bridges 314 connecting each outer ring 312 to the next successive inner ring 312 together are equally spaced around the perimeters of the inner ring 312. In particular, the three bridges 314 connecting each outer ring 312 and inner ring 312 together are spaced about 120 degrees from each other. Further, the bridges 314 connecting each outer ring to the next successive inner ring are equally spaced between any surrounding or surrounded bridges. In particular, the three bridges 314 connecting each outer ring 312 and inner ring 312 together are spaced about 60 degrees from any surrounding or surrounded bridges 314. This equal spacing of the bridges 314 maximizes the length of the conductive path, and thereby reduces thermal conduction, from the outermost of the four rings 312 to the hub 308.

Also disclosed in FIG. 2D, the bridges 314 (see FIG. 3B) and rings 312 are connected in such a way that they lie in a common plane 318. It is understood, however, that in at least some example embodiments, the rings 312 and bridges 314 may be connected in such a way that they do not lie in a common plane. For example, some rings 312 may be positioned in the plane 318 that lies at the terminal end of the fins 306 as disclosed in FIG. 2D, while other rings 312 may be positioned in a plane 320 that lies at the terminal end of the fins 304. Further, any or all of the rings 312 may be positioned at any of a variety of intermediate planes positioned between the planes 318 and 320.

As disclosed in FIG. 2D, the fins 306 of the anode 300 are interleaved with the fins 212 of the can 200. Similarly, the fins 304 are interleaved with the fins 210 of the can 200. This interleaving of the fins 304 and 306 with the fins 210 and 212, respectively, facilitates radiant transfer of heat from the anode 300 to the can 200. Further, the focal track 302, the rings 312, and each of the fins 304, 306, 210, and 212 are concentric as they share a common axis 310.

In particular, the heat generated at the focal track 302 of the anode 300 by the impingement of electrons 110 (see FIG. 1B) conducts into the fins 306. A portion of the heat that is conducted into the fins 306 transfers into the fins 212 via radiation and then conducts to, and is dissipated by, the fluid coolant (not shown) circulating through the passageways 208 of the can 200. Similarly, that portion of the heat that is conducted through the innermost fin 306 to the rings 312 conducts from the rings 312 into the fins 304. A portion of the heat that is conducted into the fins 304 transfers into the fins 210 via radiation and then conducts to, and is dissipated by, the fluid coolant (not shown) circulating through the passageways 208 of the can 200.

In at least some example embodiments, surfaces of the fins 304, 306, 210, and 212 are coated with an emissive material (not shown) that increases the emissivity of the coated surfaces, such as a titanium chromium oxide for example. The emissive coating may be applied using a flame spraying process, for example. This emissive coating further increases the efficiency the fins 304 and 306 in radiating heat away from the anode 300 and toward the fins 210 and 212 of the can 200.

Further, as disclosed in FIG. 2D, each fin 304 is thinner than each fin 306. Reducing the thickness of the fins 304 reduces the conductive cross section which maximizes the conductive flux density while maximizing the exposed surface area of the fins 304, which increases the thermal emittance of the fins 304. Similarly, each fin 210 is thinner than each fin 212. In at least some example embodiment, the fins 210 can be thinner than the fins 212 because the fins 210 are configured to conduct less heat than the fins 212.

Also, as disclosed in FIG. 2D, the fins 304 and the fins 212 extend in a first direction 322 and the fins 306 and the fins 210 extend in a second direction 324 that is opposite to the first direction. It is understood, however, that one or more of the rings 312 may be repositioned so that one or more of the fins 304 extends in the second direction 324 and one or more of the fins 210 extends in the first direction 322.

Figure 4:
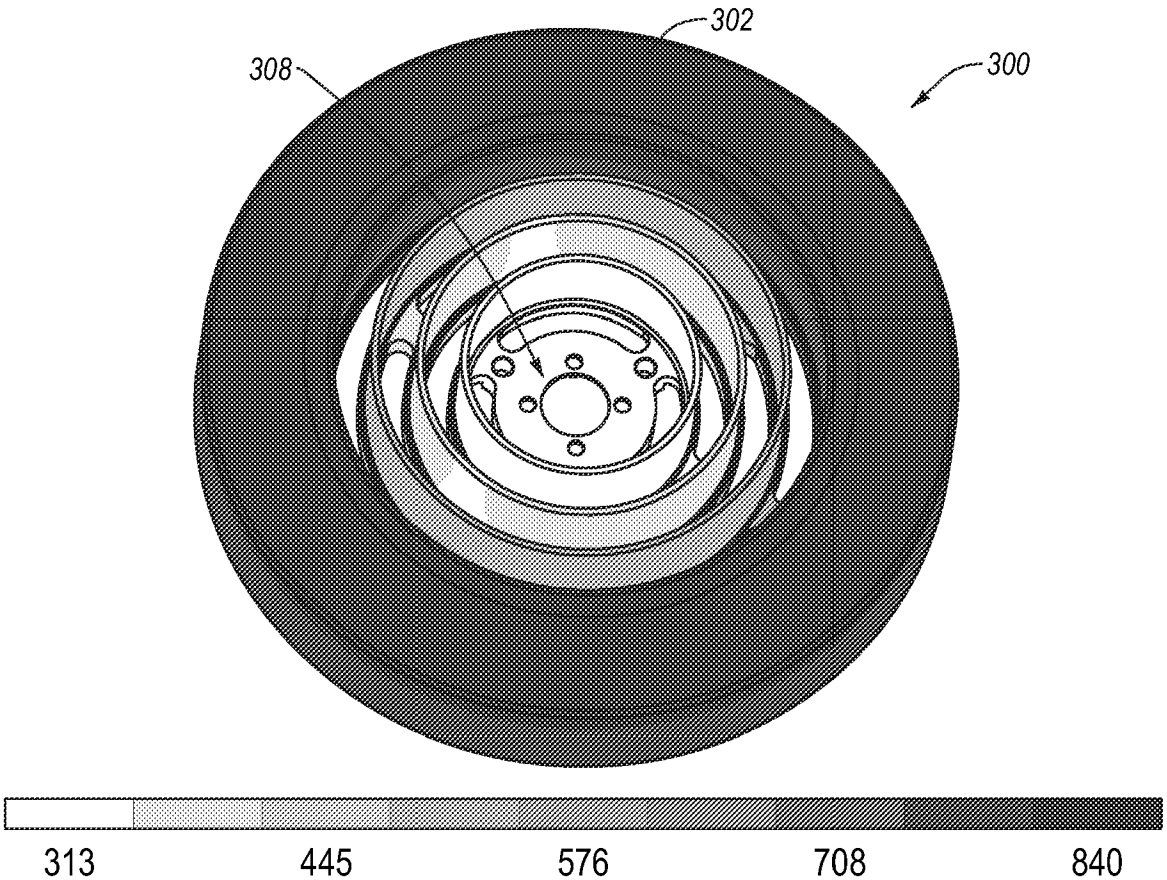
FIG. 4 is a chart of a simulated heat distribution across the example rotating anode of FIG. 3A during operation of the example rotating anode.

With reference now to FIG. 4, a simulated heat distribution across the example anode 300 during operation of the example anode 300 is disclosed. As disclosed in FIG. 4, the closer the position of the component is to the center of the anode 300, the lower the temperature of the component. For example, while the focal track 302 has a temperature of about 905 degrees Celsius, the temperature of the hub 308 is only about 313 degrees Celsius.

Accordingly, the fins 304 and 306 of the example anode 300 efficiently radiate heat, and the spacing of the bridges 314 maximizes the length of the conductive path thereby reducing the conduction of heat, resulting in reduced temperatures in the bearing assembly 400 to which the example anode 300 is attached. The reduced temperatures in the bearing assembly 400 extend the operational life of the attached bearing assembly 400, including the bearings 404, and the x-ray tube 100.

It is understood that the number of rings 312, fins 304, fins 306, bridges 314, pin openings 316, rings 210, and rings 212 can differ from the number shown in the drawings. Accordingly, the number of each of these components in the drawings is but one example and is not limiting of the current invention.

The example embodiments disclosed herein may be embodied in other specific forms. The example embodiments disclosed herein are therefore to be considered in all respects only as illustrative and not restrictive.

What is claimed is:

1. An x-ray tube rotating anode comprising:
a hub configured to attach to a bearing assembly;
rings positioned radially outward from the hub;
bridges connecting the rings together;
annular ring fins each attached to one of the rings;
a focal track positioned radially outward from the annular ring fins; and
annular focal track fins attached to the focal track.

2. The x-ray tube rotating anode as recited in claim 1, wherein three bridges connect each outer ring to the next successive inner ring.

3. The x-ray tube rotating anode as recited in claim 1, wherein two bridges connect each outer ring to the next successive inner ring.

4. The x-ray tube rotating anode as recited in claim 1, wherein the rings and the bridges lie in a common plane.

5. The x-ray tube rotating anode as recited in claim 1, wherein the bridges connecting each outer ring to the next successive inner ring are equally spaced around the perimeters of the inner ring.

6. The x-ray tube rotating anode as recited in claim 1, wherein each annular ring fin is thinner than each annular focal track fin.

7. The x-ray tube rotating anode as recited in claim 1, wherein surfaces of the annular ring fins and surfaces of the annular focal track fins are coated with a material that increases the thermal emittance of the coated surfaces.

8. The x-ray tube rotating anode as recited in claim 7, wherein the coating comprises a titanium chromium oxide.

9. An x-ray tube assembly comprising:
a can defining inner annular fins and outer annular fins; and
a rotating anode positioned within the can, the rotating anode comprising:
a focal track;
annular focal track fins attached to the focal track and interleaved with the outer annular fins of the can;
rings positioned radially inward from the focal track;
annular ring fins each attached to one of the rings and interleaved with the inner annular fins of the can;
bridges connecting the rings together; and
a hub positioned radially inward from the rings and configured to attach to a bearing assembly.

10. The x-ray tube assembly as recited in claim 9, wherein the outermost ring is attached to the innermost annular focal track fin.

11. The x-ray tube assembly as recited in claim 9, wherein:
each annular ring fin is thinner than each annular focal track fin; and
each inner annular fin is thinner than each outer annular fin.

12. The x-ray tube assembly as recited in claim 11, wherein:
the annular ring fins and the outer annular fins extend in a first direction; and
the annular focal track fins and the inner annular fins extend in a second direction that is opposite to the first direction.

13. The x-ray tube assembly as recited in claim 9, wherein surfaces of the annular ring fins, the annular focal track fins, the inner annular fins, and the outer annular fins are coated with a material that increases the emissivity of the coated surfaces.

14. The x-ray tube assembly as recited in claim 9, wherein the bridges connecting each outer ring to the next successive inner ring are equally spaced between any surrounding or surrounded bridges.

15. An x-ray tube comprising:

a bearing assembly;

an evacuated enclosure at least partially defined by a can, the can defining inner concentric fins and outer concentric fins;

a cathode positioned within the evacuated enclosure; and a rotating anode positioned within the evacuated enclosure, the rotating anode comprising:

a focal track;

concentric focal track fins attached to the focal track and interleaved with the outer concentric fins of the can;

rings positioned radially inward from the focal track;

concentric ring fins each attached to one of the concentric rings and interleaved with the inner concentric fins of the can;

bridges connecting the rings together; and a hub positioned radially inward from the rings and attached to the bearing assembly.

16. The x-ray tube as recited in claim 15, wherein the can further defines passageways configured to circulate a fluid coolant.

17. The x-ray tube as recited in claim 15, wherein:

the focal track comprises tungsten and rhenium; and the concentric focal track fins, the rings, the concentric ring fins, the bridges, and the hub comprise molybdenum, titanium, or zirconium, or some combination thereof.

18. The x-ray tube as recited in claim 15, wherein three bridges connect each outer ring to the next successive inner ring.

19. The x-ray tube as recited in claim 18, wherein the three bridges connecting each outer ring and inner ring together are spaced about 120 degrees from each other.

20. The x-ray tube as recited in claim 19, wherein the three bridges connecting each outer ring and inner ring together are spaced about 60 degrees from any surrounding or surrounded bridges.

* * * * *